US008198975B2

(12) United States Patent
Sha et al.

(10) Patent No.: US 8,198,975 B2
(45) **Date of Patent: *Jun. 12, 2012**

(54) OVER-CURRENT PROTECTION DEVICE

(75) Inventors: Yi An Sha, Xindian (TW); Kuo Chang Lo, Taipei (TW); Chin Piao Yang, Hsinchu (TW)

(73) Assignee: Polytronics Technology Corporation, Hsinchu (TW)

( * ) Notice: Subject to any disclaimer, the term of this patent is extended or adjusted under 35 U.S.C. 154(b) by 165 days.

This patent is subject to a terminal disclaimer.

(21) Appl. No.: 12/662,550

(22) Filed: Apr. 22, 2010

(65) Prior Publication Data

US 2011/0241818 A1 Oct. 6, 2011

(30) Foreign Application Priority Data

Mar. 31, 2010 (TW) ..... 99109813 A

(51) Int. Cl.
*H01C 7/10* (2006.01)

(52) U.S. Cl. ..... 338/22 R; 338/21

(58) Field of Classification Search ..... 338/22 R, 338/20, 21

See application file for complete search history.

(56) References Cited

U.S. PATENT DOCUMENTS

| | | | | |
|---|---|---|---|---|
| 4,689,475 | A * | 8/1987 | Kleiner et al. | 219/553 |
| 4,800,253 | A * | 1/1989 | Kleiner et al. | 219/553 |
| 4,959,632 | A * | 9/1990 | Uchida | 338/22 R |
| 5,900,800 | A * | 5/1999 | McGuire et al. | 338/22 R |
| 5,955,936 | A * | 9/1999 | Shaw et al. | 338/22 R |
| 6,965,293 | B2 * | 11/2005 | Choi et al. | 338/22 R |

* cited by examiner

*Primary Examiner* — Kyung Lee
(74) *Attorney, Agent, or Firm* — Stites & Harbison, PLLC; Juan Carlos A. Marquez, Esq

(57) ABSTRACT

An over-current protection device comprises two metal foils, a positive temperature coefficient (PTC) material layer and a packaging material layer. The PTC material layer is sandwiched between the two metal foils and has a volume resistivity below 0.1 Ω-cm. The PTC material layer includes (i) plural crystalline polymers having at least one crystalline polymer with a melting point less than 115° C.; (ii) an electrically conductive nickel filler having a volume resistivity less than 500 μΩ-cm; and (iii) a non-conductive metal nitride filler. The electrically conductive nickel filler and non-conductive metal nitride filler are dispersed in the crystalline polymer. The packaging material layer which encapsulates the chip is essentially comprised of the PTC layer and the two metal foils. The packaging material layer is formed by reacting epoxy resin with a hardener having amide functional group.

19 Claims, 3 Drawing Sheets

OVER-CURRENT PROTECTION DEVICE

BACKGROUND OF THE INVENTION

1. Field of the Invention

The present invention relates to an over-current protection device.

2. Description of the Prior Art

The resistance of PTC conductive material is sensitive to temperature change. Due to such property, the PTC conductive material can be used as current-sensing material and has been widely used in over-current protection devices and circuits. The resistance of the PTC conductive material remains low at room temperature so that the over-current protection device or circuit can operate normally. However, if an over-current or an over-temperature event occurs, the resistance of the PTC conductive material immediately increases to a high-resistance state (over $10^2$ ohm). Therefore, the excessive, current is blocked and the objective of protecting the circuit elements or batteries is achieved.

In general, the PTC conductive material contains one or more crystalline polymers and a conductive filler. The conductive filler is dispersed uniformly in the crystalline polymer. The crystalline polymer is mainly a polyolefin polymer such as polyethylene. The conductive filler is mainly carbon black, metal particles such as nickel, gold or silver, and/or ceramic powder such as titanium carbide or tungsten carbide.

The conductivity of the PTC conductive material depends on the content and type of the conductive filler. Generally, carbon black having a rough surface provides better adhesion with the polyolefin polymer, and accordingly, a better resistance repeatability is achieved. However, the conductivity of the carbon black is lower than that of the metal particles, so that there is a trend to replace the carbon black with metal filler. If the metal particles are used as the conductive fillers, their larger specific weight results in a less-uniform dispersion. For example, nickel fillers exhibit weak magnetism, so the filler particles accumulate easily and are not easily dispersed.

To effectively reduce the resistance of the over-current protection device and prevent uneven dispersion of the fillers, the non-conductive ceramic powder or filler is often added to metal filler material. The dispersion can be significantly improved by friction and filling behavior when blending the ceramic powder, polymer and metal filler. That is, the ceramic filler serves as a solid dispersing agent for conductive material. Moreover, since the ceramic powder lacks a rough surface like carbon black and has no obvious chemical function groups, the ceramic powder exhibits poor adhesion with the polyolefin polymer, compared to the adhesion of the carbon black to the polyolefin polymer, and consequently, the resistance repeatability of the PTC conductive material is not easy to control. A coupling agent may be added to the PTC conductive material with the metal filler, so as to improve the adhesion and reacting force between the metal filler and the polyolefin polymer, significantly reduce voids in the conductive material, and improve the resistance repeatability.

SUMMARY OF THE INVENTION

The present invention provides an over-current protection device. By adding a conductive nickel filler, a non-conductive metal nitride filler with certain particle size distribution, and least one crystalline polymer with a low melting point, the over-current protection device exhibits low resistance, fast tripping at a lower temperature, high voltage endurance and resistance repeatability. The present invention further provides a packaging material layer having epoxy resin, so as to increase anti-oxidation and reduce water or air permeation to the device.

In accordance with an embodiment of the present invention, an over-current protection device includes two metal foils, a PTC material layer and a packaging material layer. The PTC material layer is sandwiched between the two metal foils and has a volume resistivity less than 0.1 Ω-cm. The PTC material layer includes (i) plural crystalline polymers including at least one crystalline polymer having a melting point less than 115° C.; (ii) an electrically conductive nickel filler having a volume resistivity less than 500 μΩ-cm; and (iii) a non-conductive metal nitride filler. The conductive nickel filler and non-conductive metal nitride filler are dispersed in the crystalline polymer.

In an embodiment, the metal foils have rough surfaces with nodules and directly contact the PTC material layer. The nickel filler may be powder with a particle size distribution between 0.01 μm and 30 μm, and more preferably between 0.1 μm and 15 μm. The nickel filler exhibits a volume resistivity below 500 μΩ-cm and is dispersed in the crystalline polymers. The crystalline polymers may be selected from high-density polyethylene (HDPE), low-density polyethylene (LDPE), polypropylene, polyvinyl chlorine and polyvinyl fluoride. The PTC material layer has a crystalline polymer with a melting point below 115° C. to achieve the objective of fast tripping ability at low temperatures.

To prevent the lithium batteries from overcharge, an over-current protection device applied thereto is required to trip at a low temperature. Therefore, the PTC material layer used the over-current protection device of the present invention may contain polyolefin polymer with a lower melting point (e.g., LDPE, polyvinyl wax or vinyl polymer), copolymer of olefin monomer and acrylic monomer (e.g., copolymer of ethylene and acrylic acid or copolymer of ethylene and acrylic resin) or copolymer of olefin monomer and vinyl alcohol monomer (e.g., copolymer of ethylene and vinyl alcohol), and may include one or more crystalline polymer materials including at least one polymer with a melting point below 115° C. The above LDPE can be polymerized using Ziegler-Natta catalyst, Metallocene catalyst or other catalysts, or can be copolymerized by vinyl monomer or other monomers such as butane, hexane, octene, acrylic acid, or vinyl acetate.

The non-conductive metal nitride filler used in the present invention is selected from the metal nitride compounds with flame-retardant, anti-arcing or lubricant characteristics, such as aluminum nitride, boron nitride or silicon nitride. These non-conductive ceramic powders can be of various shapes, e.g., spherical, cubical, flake, polygonal or cylindrical shape. The particle size of the non-conductive ceramic filler is essentially between 0.1 μm and 30 μm, and the non-conductive filler is 1% to 30% by volume of the total composition of the PTC material layer.

Current low resistance (approximately 20 mΩ) PTC conductive material having nickel conductive fillers can withstand only 6 volts. Because the nickel particles exhibiting weak magnetism are not easily dispersed in the material, the unevenly dispersed nickel particles significantly reduce the voltage endurance capability. Moreover, strong accumulating behavior of nickel particles tremendously reduces the machinability of polymers. As mentioned above, the addition of non-conductive metal nitride filler can efficiently increase the dispersion of the nickel particles, thereby increasing the voltage endurance and machinability.

The volume resistivity of the electrically conductive filler is extremely low (below 500 μΩ-cm) and thus the PTC material layer containing the electrically conductive filler can achieve a resistivity below 0.5 Ω-cm. In general, the lowest resistivity limit of the conventional PTC material is around 0.1 Ω-cm. Even if the resistivity of the metal powder filled PTC material falls below 0.1 Ω-cm, this type of PTC material still fails to maintain voltage endurance due to excessive loading of metal powder and the lack of dielectric property of the PTC material. However, the PTC material layer including non-conductive metal nitride filler in accordance with the present invention can reach a resistivity below 0.1 Ω-cm and can still sustain a voltage less than or equal to 28V, preferably from 6V to 28V, or most preferably from 12V to 28V, and a current up to 50 A.

When the conventional PTC material reaches a volume resistivity below 0.1 μΩ-cm, it usually cannot sustain voltage higher than 12V. To increase the voltage endurance, non-conductive metal nitride filler essentially including inorganic nitrogen compound is added to the PTC material, and the PTC material layer is configured with a thickness greater than 0.1 mm, so that the PTC material of low resistivity can significantly increase the endurance voltage. The addition of the inorganic compound (non-conductive metal nitride filler) to the PTC material layer can alter the trip jump value (i.e., $R_1/R_i$ indicating the resistance repeatability) to below 3, where $R_i$ is the initial resistance value and $R_1$ is the resistance measured one hour after returning to room temperature.

Since the PTC material layer exhibits extremely low resistivity, the area of the PTC chip (i.e., the PTC material layer required in the over-current protection device of the present invention) cut from the PTC material layer can be reduced to below 50 $mm^2$, preferably below 30 $mm^2$, and the PTC chip will still exhibit the property of low resistance. Accordingly, more PTC chips can be produced from a single PTC material layer, and thus the cost is reduced.

The over-current protection device further comprises two metal electrode sheets, connected to the two metal foils by solder reflow or by spot welding to form an assembly. The shape of the assembly (the over-current protection device) is axial-leaded, radial-leaded, terminal, or surface-mounted. Also, the two metal foils or the two metal electrode sheets may connect to a power source to form a conductive circuit loop such that the over-current protection device protects the circuit when an over-current occurs.

The packaging material layer which encapsulates the chip is essentially comprised of the PTC layer anti the two metal foils. The packaging material layer is formed by reacting epoxy resin with a hardener having amide functional group. In an embodiment, the epoxy resin may be selected from bisphenol A or bisphenol IF epoxy resin. The hardener may include polyamide, dicyandiamide or other compound having amide function group. The packaging material layer at least encapsulates the chip and a part of the metal foils. Preferably, the epoxy resin of the packaging material layer may include a non-conductive filler of 2% to 45% by volume, so as to significantly increase the material hardness, and decrease water or air permeation and increase flame retardant capability.

BRIEF DESCRIPTION OF THE DRAWINGS

The invention will be described according to the appended drawings in which.

DETAILED DESCRIPTION OF THE INVENTION

The following describes the compositions of Example I, Example II, Example III, Example IV, Comparative Example 1 and Comparative Example 2 and the manufacturing processes of the over-current protection device of the present invention with accompanying figures.

The composition and weight (in grams) of the PTC material layer in the over-current protection device of the present invention are shown in Table 1 below.

TABLE 1

| Composition | LDPE-1 (g) | HDPE-1 (g) | HDPE-2 (g) | BN (g) | AlN (g) | $Si_3N_4$ (g) | Carbon Black (g) | Ni (g) |
|---|---|---|---|---|---|---|---|---|
| Example I | 8.5 | 16.5 | — | 5 | — | — | — | 160 |
| Example II | 8.2 | — | 17.6 | 4.4 | — | — | — | 156 |
| Example III | 8.5 | 16.5 | — | — | 5.2 | — | — | 160 |
| Example IV | 8.2 | | 17.6 | — | — | 5.4 | — | 160 |
| Comparative Example 1 | — | 8.1 | 10.2 | — | — | — | — | 150 |
| Comparative Example 2 | — | 9.2 | 9.7 | 3.6 | — | — | 33 | — |

In Table 1, LDPE-1 is a low-density crystalline polyethylene (density: 0.924 g/$cm^3$; melting point: 113° C.); HDPE-1 as a high-density polyethylene (density: 0.943 g/$cm^3$; melting point: 125° C.); HDPE-2 is a high-density polyethylene (density: 0.961 g/$cm^3$; melting point: 131° C.); boron nitride (BN) of 96.9 wt % purity, aluminum nitride (AlN) or silicon nitride ($Si_3N_4$) is selected to be the non-conductive metal nitride filler; nickel or carbon black is used as the electrically conductive filler. The average particle size of nickel filler is between 0.1 and 15 μm, and the aspect ratio thereof is less than 10.

The manufacturing process of the over-current protection device is described as follows. The raw material is fed into a blender (HAAKE 600) at 160° C. for two minutes. The procedure of feeding the raw material includes adding the crystalline polymers into the blender according to Table 1; then, after blending for a few seconds, adding the nickel powder with particle size distribution between 0.1 μm and 15 μm and non-conductive filler boron nitride with particle size between 0.1 and 30 μm. The rotational speed of the blender is set at 40 rpm. After blending for three minutes, the rotational speed is increased to 70 rpm. After blending for 7 minutes, the mixture in the blender is drained and thereby forms a conductive composition with positive temperature coefficient (PTC) behavior.

Figure 1:
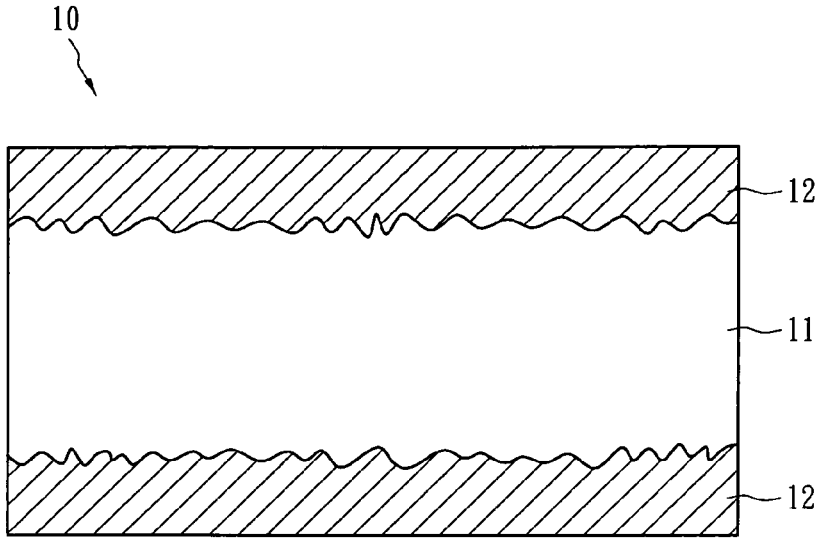
FIGS. 1 to 3 illustrate an embodiment of the over-current protection device of the present invention.

The above conductive composition is loaded symmetrically into a mold with outer steel plates and a 0.35 mm and 0.2 mm thick middle, wherein the top and the bottom of the mold are disposed with a Teflon cloth. The mold loaded with the conductive composition is pre-pressed for three minutes at 50 kg/cm$^2$ and 180° C. Then the generated gas is exhausted and the mold is pressed for 3 minutes at 100 kg/cm$^2$ and 180° C. Next, the press step is repeated once at 150 kg/cm$^2$ and 180° C. for three minutes to form a PTC material layer 11 (refer to FIG. 1). In an embodiment, the thickness of the PTC material layer 11 is 0.27 mm or 0.4 mm, i.e., the thickness is greater than 0.1 mm, or preferably greater than 0.2 mm.

Figure 2:
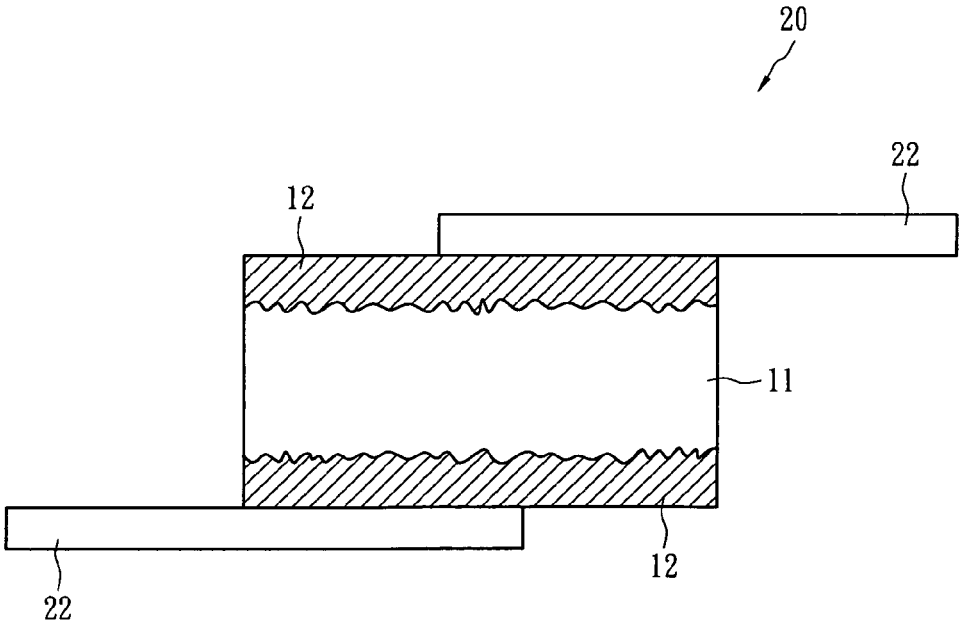
Figure 3:
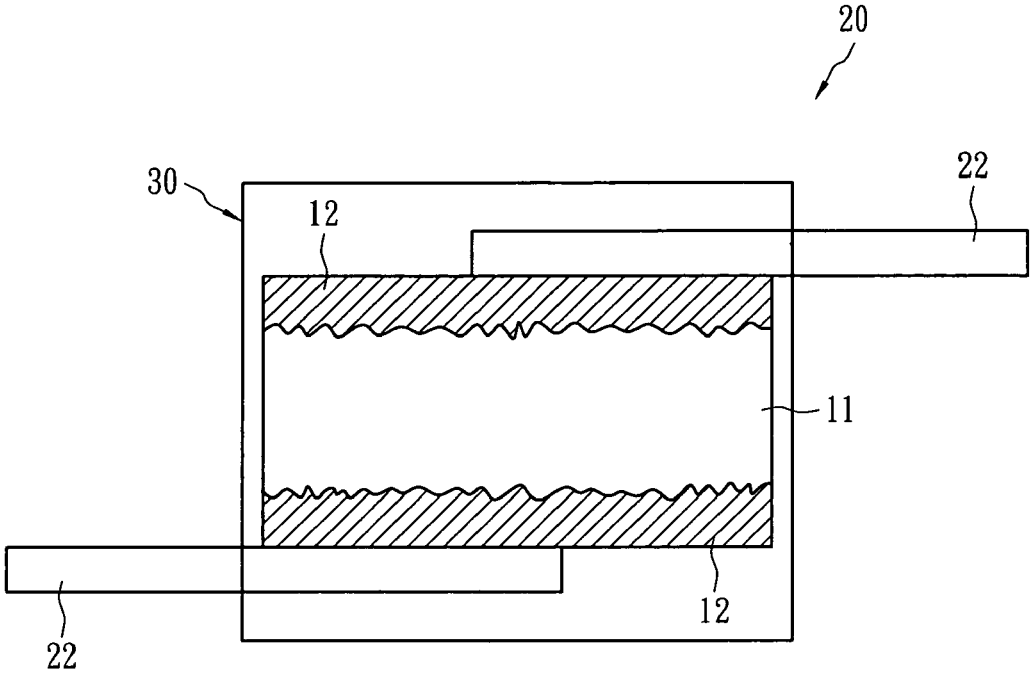

The above PTC material layer 11 is cut into many squares, each with an area of 20×20 cm$^2$. Then, two metal foils 12 physically contact the top surface and the bottom surface of the PTC material layer 11, in which the two metal foils 20 are symmetrically placed upon the top surface and the bottom surface of the PTC material layer 11. Each metal foil 12 uses a rough surface with plural nodules to physically contact the PTC material layer 11. Next, teflon cloths and the steel plates are pressed to form a multi-layered structure. The multi-layered structure is again pressed for three minutes at 70 kg/cm$^2$ and 180° C. Next, the multi-layered structure is punched or cut to form the over-current protection device 10 of 2.8 mm×3.5 mm, or 5 mm×12 mm. After that, two metal electrode sheets 22 are connected to the metal foils 12 by solder reflow to form an axial-leaded over-current protection device 20, as shown in FIG. 2. In FIG. 3, the axial-leaded over-current protection device 20 is covered by a packaging material layer 30 formed by Epon 828 epoxy resin (Shell Corporation) of 55% by volume and V-40 polyamide hardener (Shell Corporation) of 25% by volume and silicon dioxide inorganic filler (Cabot) of 20% by volume. The covered device is baked and hardened at 125° C.

The epoxy resin may include bisphenol A or bisphenol F epoxy resin. Moreover, the hardener has amide function group such as polyamide, dicyandiamide, or function group essentially including —NHCO— or —R—NHCO—R—, where R is alkyl, phenyl, diphenyl, or naphthyl group. The packaging material may include epoxy resin of 40-88% by volume and a hardener of 10-25% by volume. In addition, the packaging material layer may further include non-conductive inorganic filler, such as clay, aluminum oxide, silicon oxide, titanium oxide, magnesium oxide, magnesium hydroxide, aluminum hydroxide, aluminum nitride or boron nitride, of 2% to 45% by volume.

Table 2 shows the test results of the over-current protection devices 10 and 20.

The volume resistivity (ρ) of the PTC material layer 11 is calculated by formula (1) below.

$$\rho = \frac{R \times A}{L} \tag{1}$$

where R, A, and L indicate the resistance (Ω), the area (cm$^2$), and the thickness (cm) of the PTC material layer 11, respectively. Substituting the initial resistance of 0.0061Ω (refer to Ri of Example II of Table 2 below), the area of 2.8×3.5 mm$^2$, and the thickness of 0.4 mm for R, A, and L in formula (I), respectively, results in a resistivity (ρ) of 0.0149 Ω-cm, which is much lower than 0.1 Ω-cm. For Example I, ρ=0.0167 Ω-cm.

The axial-leaded over-current protection device 20 undergoes a trip test under the conditions of 6V/0.8 A at 80° C. to simulate a situation in which the temperature of the battery equipped with the axial-leaded over-current protection device 20 increases to 80° C. in the over-charge condition of 6V/0.8 A and the axial-leaded over-current protection device 20 has to trip and cut off the current to protect the battery.

Table 2 shows that Example I to Example IV can trip in the trip test; however, the Comparative Example 1, which does not contain boron nitride, does not trip to protect the battery. The surface temperatures of the axial-leaded over-current protection device 20 under 6V, 12V, and 16V is (i.e., under the trip state of over-current protection) are shown in Table 2. Comparative Example 1 exhibits surface temperatures above 100° C., at least 10° C. higher than those of Examples I to IV, in which the surface temperatures are below 100° C. Comparative Example 2 using carbon black has an initial resistivity of 12.3 mΩ, which is much greater than that of the material using nickel filler. Therefore, the over-current protection devices in the four embodiments (i.e., Examples I to IV) can trip at a lower temperature and are more sensitive to temperature than Comparative Examples 1 and 2. The over-current protection devices of the embodiments using the nickel filler have initial resistances ($R_i$) below 15 mΩ.

TABLE 2

| | Chip Size (mm × mm) | Thickness (mm) | $R_i$ (mΩ) | ρ (Ω-cm) | Trip Test 6 V 80° C./ 0.8 A | Surface Temperature @ Trip State 6 V/6 A | 12 V/6 A | 16 V/6 A |
|---|---|---|---|---|---|---|---|---|
| Example I | 2.8 × 3.5 | 0.4 | 6.8 | 0.0167 | Trip | 85° C. | 88° C. | 92° C. |
| Example II | 2.8 × 3.5 | 0.4 | 6.1 | 0.0149 | Trip | 87° C. | 89° C. | 91° C. |
| Example III | 2.8 × 3.5 | 0.4 | 6.7 | 0.0164 | Trip | 84° C. | 86° C. | 89° C. |
| Example IV | 2.8 × 3.5 | 0.4 | 6.9 | 0.0168 | Trip | 88° C. | 90° C. | 95° C. |
| Comparative Example 1 | 2.8 × 3.5 | 0.4 | 5.5 | 0.0135 | No Trip | 102° C. | 105° C. | 109° C. |
| Comparative Example 2 | 5 × 12 | 0.27 | 12.3 | 0.273 | Trip | 78° C. | 80° C. | 81° C. |

From Table 2, it can be seen that, by adding a conductive nickel filler with a certain particle distribution, a non-conductive metal nitride filler, and at least one crystalline polymer with a low melting point (below 115° C.), the over-current protection device of the present invention meets the objectives of excellent resistance (the initial resistance Ri below 15 mΩ or 10 mΩ), fast tripping at a lower temperature (e.g., 80° C.), high voltage endurance, and resistance repeatability.

The over-current protection devices with and without packaging material layer are compared below. Table 3 shows the composition of the over-current protection devices.

TABLE 3

| | LDPE-1 | LDPE-2 | HDPE-1 | HDPE-2 | Packaging material layer | Ni |
|---|---|---|---|---|---|---|
| Comparative Example 3 | 8.5 | — | 16.5 | — | No | 160 |
| Comparative Example 4 | — | 7.7 | — | 17.6 | No | 153 |
| Example V | 9.3 | — | 10.2 | — | Yes | 150 |
| Example VI | — | 8.5 | — | 9.7 | Yes | 158 |

d

LDPE-1 is a low-density crystalline polyethylene (density: 0.924 g/cm$^3$; melting point: 113° C.); LDPE-2 is a low-density crystalline polyethylene (density 0.92 g/cm$^3$, melting point: 105° C.); HDPE-1 is a high-density polyethylene (density: 0.943 g/cm$^3$; melting point: 125° C.); HDPE-2 is a high-density polyethylene (density: 0.961 g/cm$^3$; melting point: 131° C.); nickel is used as the electrically conductive filler. The average particle size of nickel filler is between 0.1 and 15 μm, and the aspect ratio thereof is less than 10.

Figure 4:
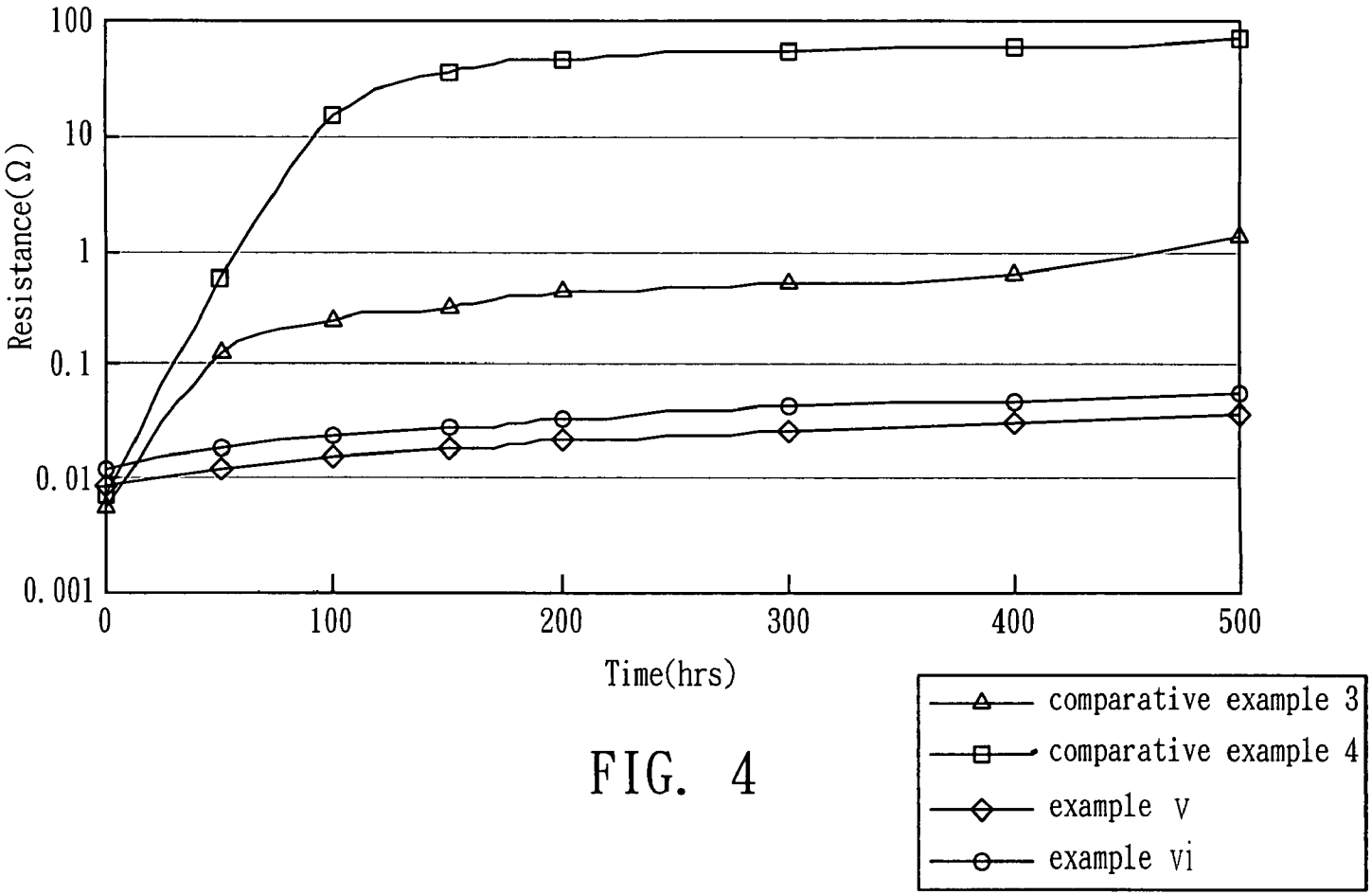
FIG. 4 illustrates the comparison of the over-current protection devices with and without packaging material layer in accordance with the present invention.

FIG. 4 shows the resistance variations of the devices of the Examples and Comparative Examples under 12 volts. It can be seen that the resistances of the devices with packaging material layer do not vary significantly over time. However, the resistances of the devices of Comparative Examples 3 and 4 significantly increase from 0.01Ω to 0.1Ω after 500 hours. Although such devices are still workable, the nickel becomes inactive due to permeation of water or oxygen gas. Without the protection of the packaging material, the polymer of the devices is degraded after applying a voltage for a long time. The resistances of the devices of Examples V and VI having packaging material layers are below 0.1Ω, demonstrating that the reliability of the devices can be significantly increased and the objective of battery protection can be achieved.

In summary, to effectively increase anti-oxidation of the metal filler, a material of epoxy resin/amide hardener may be coated on the chip. A non-conductive filler may be further added to the resin. The epoxy/amide resin can reduce the amount of water and oxygen penetrating into the chip. The non-conductive inorganic filler can increase the hardness of the resin, restrict the expansion of PTC device when applying a voltage on it, and increase the recovery capability of the devices. The non-conductive inorganic filler can increase the path for oxygen penetration, so as to reduce the permeation of water and gas. The nano-size and flake-shaped inorganic fillers are most effective.

The devices and features of this invention have been sufficiently described in the above examples and descriptions. It should be understood that any modifications or changes without departing from the spirit of the invention are intended to be covered in the protection scope of the invention.

What is claimed is:

1. An over-current protection device, comprising:

two metal foils; and a positive temperature coefficient (PTC) material layer sandwiched between the two metal foils, exhibiting a volume resistivity below 0.1 Ω-cm, and comprising:

a plurality of crystalline polymers, wherein at least one of the crystalline polymers exhibits a melting point below 115° C.; and an electrically conductive nickel filler having a particle size from 0.1 μm to 15 μm and a volume resistivity below 500 μΩ-cm; and a non-conductive metal nitride filler;

wherein the electrically conductive nickel filler and the non-conductive metal nitride filler are dispersed in the crystalline polymers;

a packaging material layer covering the two metal foils and the PTC material layer and comprising epoxy resin formed by reacting with a hardener, the hardener comprising amide compound function group.

2. The over-current protection device of claim 1, wherein the PTC material layer has a thickness greater than 0.1 mm.

3. The over-current protection device of claim 1, wherein the PTC material layer has an initial resistance less than 15 mΩ.

4. The over-current protection device of claim 1, wherein the at least one of the crystalline polymers with the melting point below 115° C. comprises polyolefin polymer.

5. The over-current protection device of claim 4, wherein the polyolefin polymer comprises LDPE or polyvinyl wax.

6. The over-current protection device of claim 1, wherein the at least one of the crystalline polymers with the melting point below 115° C. comprises olefin monomer and acrylic monomer.

7. The over-current protection device of claim 1, wherein the at least one of the crystalline polymers with the melting point below 115° C. comprises copolymer of olefin monomer and vinyl alcohol monomer.

8. The over-current protection device of claim 1, wherein the non-conductive metal nitride filler comprises aluminum nitride, boron nitride or silicon nitride.

9. The over-current protection device of claim 1, wherein the non-conductive metal nitride filler has a particle size between 0.1 μm and 30 μm.

10. The over-current protection device of claim 1, wherein the non-conductive metal nitride filler is 1% to 30% by volume of the PTC material layer.

11. The over-current protection device of claim 1, further comprising two metal electrode sheets connected to the two metal foils.

12. The over-current protection device of claim 1, wherein the epoxy resin comprises bisphenol A or bisphenol F epoxy resin.

13. The over-current protection device of claim 1, wherein the epoxy resin is 40% to 88% by volume of the packaging material layer.

14. The over-current protection device of claim 1, wherein the hardener essentially comprises a function group of —R—NHCO—R—, where R is alkyl, phenyl, diphenyl, or naphthyl group.

15. The over-current protection device of claim 1, wherein the hardener comprises polyamide or dicyandiamide.

16. The over-current protection device of claim 1, wherein the hardener is 10% to 25% by volume of the packaging material layer.

17. The over-current protection device of claim 1, wherein the packaging material layer further comprises a non-conductive filler.

18. The over-current protection device of claim 17, wherein the non-conductive filler comprises clay, aluminum oxide, silicon oxide, titanium oxide, magnesium oxide, magnesium hydroxide, aluminum hydroxide, aluminum nitride or boron nitride.

19. The over-current protection device of claim 17, wherein the non-conductive filler is 2% to 45% by volume of the packaging material layer.

* * * * *